United States Patent [19]

Buijtendorp

[11] 4,249,741

[45] Feb. 10, 1981

[54] BOARD FOR THREE PLAYER DRAUGHTS AND THE LIKE

[75] Inventor: Thomas M. Buijtendorp, Bleiswijk, Netherlands

[73] Assignee: Uitgeverij Van der Laken, Bleiswijk, Netherlands

[21] Appl. No.: 939,354

[22] Filed: Sep. 5, 1978

[30] Foreign Application Priority Data

Sep. 6, 1977 [NL] Netherlands ..... 7709777

[51] Int. Cl.[3] ..... H63F 3/02

[52] U.S. Cl. ..... 273/261

[58] Field of Search ..... 273/260, 261, 266, 258, 273/242, 243; D21/24

[56] References Cited

U.S. PATENT DOCUMENTS

| | | | |
|---|---|---|---|
| D. 74,025 | 12/1927 | Rapport | D21/24 |
| D. 231,848 | 6/1974 | Mobert | 273/261 X |
| 3,652,091 | 3/1972 | Zurbin | 273/261 |
| 3,776,554 | 12/1973 | Capablanca et al. | 273/261 |
| 3,917,273 | 11/1975 | Blakewood | 273/261 |
| 3,963,242 | 6/1976 | Treuqut et al. | 273/261 |
| 3,998,464 | 12/1976 | Poturalski | 273/261 |
| 4,026,557 | 5/1977 | LeBrun et al. | 273/261 X |

FOREIGN PATENT DOCUMENTS

| | | | |
|---|---|---|---|
| 2228465 | 1/1974 | Fed. Rep. of Germany | 273/261 |
| 335792 | 2/1904 | France | 273/261 |
| 575243 | 5/1976 | Switzerland | 273/261 |

*Primary Examiner*—Richard C. Pinkham
*Assistant Examiner*—Scott L. Brown
*Attorney, Agent, or Firm*—Morgan, Finnegan, Pine, Foley & Lee

[57] ABSTRACT

A game board for the simultaneous play of draughts, chess and the like by three players. The board is of hexagonal shape with a three-sided blocking area in the center. The board is divided into three equal territories. On the board a lattice of $3 \times \frac{1}{2}a \times b$ playing fields.

6 Claims, 2 Drawing Figures

BOARD FOR THREE PLAYER DRAUGHTS AND THE LIKE

BACKGROUND OF THE INVENTION

This invention is in the field of amusement devices.

THE PRIOR ART

Numerous variations of the standard two-man chess game have been devised, permitting play by three participants. In one version, there is provided a hexagonally-shaped configuration divided into 3×32 playing squares or fields. In the centre of the board six fields meet. One disadvantage is that for the movement in the centre extra rules have to be introduced. One example of such a rule is that passing the centre a bishop changes color, or to avoid this, the bishop may move further in one of two directions. It is likely that the introduction of such rules discourages players used to the rules of the standard two-man chess. This argument is also true for the game of draughts, where a draughtsman passing the centre also can choose between two directions.

In another prior version there is provided a game board with a central directing area. One disadvantage of this solution is that this area is likely to disorientate the players both by its shape and by the necessity of the introduction of extra playing rules. A second disadvantage is that an excessive amount of material is necessary.

SUMMARY OF THE INVENTION

There is provided in accordance with this invention a game board for the play of games normally played by two persons, such as draughts, chess, stratego and the like, by three players with only slight adaptations to the playing rules. The board is of hexagonal shape with a three-sided symmetrical blocking area in the centre.

DESCRIPTION OF THE PREFERRED EMBODIMENTS

Figure 1:
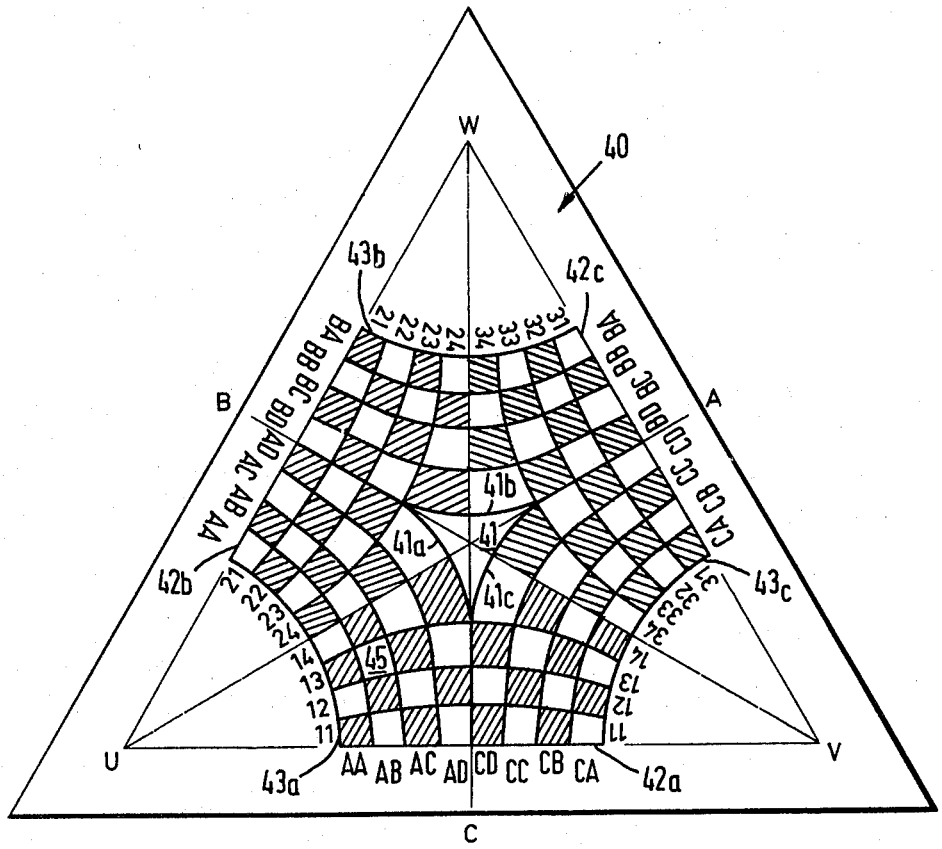
FIG. 1 is a plan view of one embodiment of a game board in accordance with the present invention.

Referring to FIG. 1, the game board 40 is a planar member having indicia thereon defining a central blocking area 41 with three borderlines 41*a*, 41*b* and 41*c*. The circumference of the board is enclosed within an equilateral triangle UVW and consists of three straight starting lines 42*a*, 42*b* and 42*c* as well as three arcuate borderlines 43*a*, 43*b* and 43*c*. The configuration of the starting lines and border-lines as shown is given by way of example only. Clearly many topographical variations are possible in this respect. The board has indicia thereon defining 3×32 playing fields of alternately light and dark colors. On each of the starting lines a dark playing field is provided at the left-hand bottom corner. The lines UA, UB and UC are axes of symmetry. On the starting lines 42*a*, 42*b* and 42*c* the indicia AA, AB, AC, AD, CD, CC, CB and CA; BA, BB, BC, BD, AD, AC, AB and AA; CA, CB, CC, CD, BD, BC, BB and BA define twelve rows. On the border-lines 43*a*, 43*b* and 43*c* the indicia 11, 12, 13, 14, 24, 23, 22 and 21; 21, 22, 23, 24, 34, 33, 32 and 31; 31, 32, 33, 34, 14, 13, 12 and 11 define twelve columns. Rows and columns form a reference which allows each playing field to be indicated with a letter-cipher combination. As an example, the field defined by the indicium 45 is formed by the intersection of column AB and row 13, and can be indicated as playing field AB13. When the board is used for playing three-participant chess, three sets of chessmen, each of different color, such as white, red and black, are positioned on the base lines 42*a*, rows 11 and 12; 42*b*, rows 21 and 22; and 43*b*, rows 31 and 32. Their position is the same as with standard chess, with one exception: all the queens have to be on a light-colored field, the kings on a dark-colored field. The rules for the movement of the pieces of the normal two-man chess are easily transferred to rules for the movement of chess pieces on the game board 40. This is illustrated by the following examples. A rook placed on field AB13 can move on the column AB or the row 13. A knight placed on AB13 can jump to any of the fields AA11, AA24, AC24, AD14, AD12 and AC11. A bishop placed on AB13 can move on the diagonal formed by the fields AA1, AB13, AC14, AD24, BD23, BC22 and BB21, as well as on the diagonal formed by AD11, AC12, AB13 and AA14. The function of the central blocking area 41 is also easily understood: it blocks the rows 14, 24 and 34. As an example a rook placed on field AA14 is stopped in its movement on row 14 at field AD14. It is also easily seen that a bishop moving on the diagonal AA11, AB12, AC13, AD15 is stopped at field AD14.

In an identical way the rules of movement of draughtsmen of the two-man draughts are easily translated to rules for a three-participant version.

Figure 2:
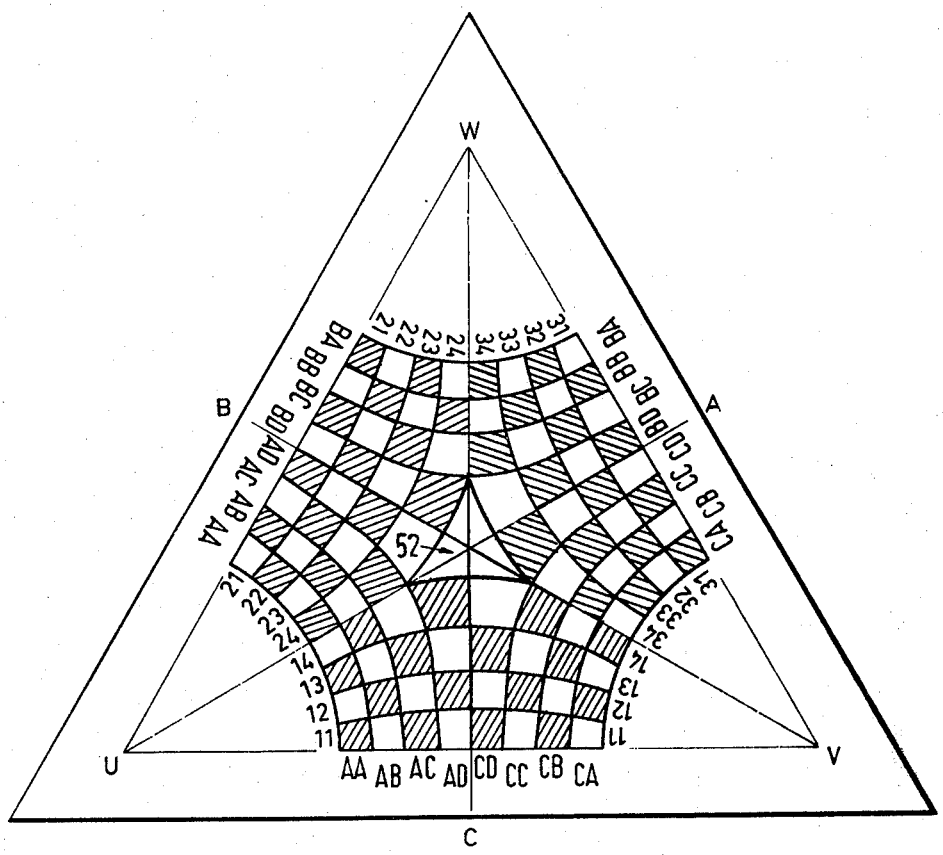
FIG. 2 is a view similar to FIG. 1, showing a different embodiment of a game board of the present invention, in which the blocking area is rotated through 60° relative to that of FIG. 1.

It is also possible to devise extensions of existing two-man games which on this board also are played by two persons. An example is an extension of the normal number of chess pieces, which extra pieces are placed on base line 42*b*, the rest of the two chess armies in the normal configuration of baselines 41*a* and 41*c*. In FIG. 2 another possible form of the board is shown, the only difference with FIG. 1 being that the central blocking area 52 is turned 60 degrees. In this configuration, the rows 14, 24, 34 are not blocked, but the columns AD, BD, CD are. This board is less suitable for chess as it blocks the movement of the centre pawns. Also a variation is possible where the blocking area is diminished in such a way that it no longer blocks in a clear way any column or row, but only diagonal movements. With this solution the function of the central area is not very clear and the playing fields in the centre are more distorted. International draughts is played on a square board with 10×10 playing fields. Accordingly a board for three-player international draughts must have $3\times\frac{1}{2}\times10\times10$ playing fields. Generally speaking, a board according to this invention, for playing a game with three persons, that normally is played by two players on a board with a×b playing fields, will have $3\times\frac{1}{2}a\times b$ playing fields.

SUGGESTIONS FOR THE RULES OF PLAY

The rules of play for three-participant variations of existing games for two players are likely to need only adaptation of the rules for the beginning and the end of the play. As an example the rules for a three-person variant of chess are given.

BEGINNING OF THE GAME

The chessmen are placed along the straight sides of the board in the same sequence as in the normal game of chess with the exception that all queens are to be placed on a white playing field. White begins. The players further take their turns in a clockwise direction.

END OF THE GAME

If a player is to make a move and his or her king is checkmated, the game is finished. The player on his right side is the winner and receives two points. Both other players have lost and get zero points. If a player is to make a move and his or her king is stalemate the game is finished. The three players receive one point each. All other rules are identical to the rules of two-man chess.

It should be noted that with these rules it is unattractive for the players to form alliances. Therefore, the game continues to be an individual game, as the normal chess game is.

In the same way other games, such as draughts, can be adapted.

I claim:

1. A game board with which games that are normally played by two players on a rectangular board of $a \times b$ fields can be played by three players on one board with minor adaptations of the rules, characterized by said one board having a hexagonal outer circumference and a blocking area in the centre, there being three lines of symmetry, three opposed sides of the board being bounded by a fields and three other opposing sides by b fields, and the lengths and shapes of the sides and the boundary of the blocking area being designed so as to form a pattern of $3 \times \frac{1}{2}a \times b$ substantially rectangular fields of approximately equal size, with the board having three axes of symmetry.

2. A game board according to claim 1, wherein the blocking area in the centre has three sides designed so that all lines of play extending from three non-adjacent sides of the board to the two opposing sides are uninterrupted; and that of the lines of play extending substantially parallel to said three non-adjacent sides of the board, the respective ones located closest to the centre of the board are interrupted by said blocking area.

3. A game board according to claim 1, wherein three non-adjacent sides of the board are rectilinear.

4. A game board according to claim 1, wherein the fields are of two different colors in accordance with the pattern of a chessboard.

5. A game board according to claim 4, wherein all the sides of the board are bounded by 8 fields.

6. A game board according to claim 1, wherein the fields are of two different colors in accordance with the pattern of a chessboard, the board has three non-adjacent rectilinear sides, and all the sides of the board are bounded by 8 fields with a field of the darker color at the left end of each of said non-adjacent rectilinear sides.

* * * * *